US005460227A

United States Patent [19]

Sidrim

[11] Patent Number: 5,460,227

[45] Date of Patent: Oct. 24, 1995

[54] UNDERSEA INTEGRATED REPRESSURIZATION SYSTEM AND METHOD

[75] Inventor: Fernando Antonio C. Sidrim, Rio de Janeiro, Brazil

[73] Assignee: Petroleo Brasileiro S.A., Rio de Janeiro, Brazil

[21] Appl. No.: 235,522

[22] Filed: Apr. 29, 1994

[30] Foreign Application Priority Data

Apr. 5, 1993 [BR] Brazil ..... 9301439

[51] Int. Cl.[6] ..... E21B 43/36; E21B 43/40

[52] U.S. Cl. ..... 166/357; 166/267; 210/170

[58] Field of Search ..... 166/357, 267, 166/265, 366; 210/170

[56] References Cited

U.S. PATENT DOCUMENTS 3,608,630 9/1971 Wooden et al. ..... 166/357
4,527,632 7/1985 Chandot ..... 166/357
4,705,114 11/1987 Schroeder et al. ..... 166/357
4,793,418 12/1988 Wheeler et al. ..... 166/357
4,982,794 1/1991 Houot ..... 166/357

*Primary Examiner*—Hoang C. Dang
*Attorney, Agent, or Firm*—Sughrue, Mion, Zinn, Macpeak & Seas

[57] ABSTRACT

An undersea integrated repressurization system includes a first undersea separator (1) on the sea bottom (2) at which output from one or more wells (A, B, C and D) is collected with gas flowing through a low pressure gas line (3) to production platform (4) and oil flowing to a repressurization well (5). A power gas line (6) extends from compressor (7) on production platform (4) for injection of gas into the lower end of a pipe adjacent the bottom of the repressurization well (5), through an opening (8) whereby the oil and gas rise through the pipe to a second undersea separator (9) on the sea bottom (2). The separated oil then enters oil pipeline (10) along which the oil flows and the separated gas enters a high pressure gas pipeline (11) which carries the gas, both leading to a production platform (4).

10 Claims, 2 Drawing Sheets

UNDERSEA INTEGRATED REPRESSURIZATION SYSTEM AND METHOD

FIELD OF INVENTION

The invention is directed to an undersea integrated repressurization system and method used or the undersea separation of oil and gas along with pumping out of the separated oil and with remote control of the system, without any moving parts on the sea bottom.

DESCRIPTION OF PRIOR ART

Undersea separation has never actually replaced offshore production platforms, particularly those in deep water, because up to now there has never been equipment reliable enough to pump out the separated oil by remote control under the usually unsuitable conditions at the bottom of the sea. An example of such separation is referred to in the publication GB 2,177,739 A of Jan. 28, 1987 dealing with an undersea system for the conveying of a multiphase flow of hydrocarbons drawn from an undersea well located at a distance from storage and treatment equipment, including an undersea template linked up to a series of wells, so that a mixed hydrocarbon flow is conveyed from such wells to a liquid separator which breaks it up into a fluid and a gas flow which run along a riser to the treatment and storage equipment.

Another example of such kind of separation is to be seen in BR 8901686 which deals with an undersea hydrocarbon producing facility together with an oil-gas separator and at least one production well head and an oil-gas separator going a long way down most of which can be housed in a cased well hole close to the drilling well. This enables great changes to take place in the degree of oil-gas at top and bottom control points, and ensures that the pump with which the separator is fitted is sufficiently submerged and allows gas to flow out separately from one side and sufficiently degasified oil to flow from the other side from a point on the outside to a central production station.

However, as already mentioned, such systems are still not reliable enough nor able to pump out oil separately under remote control, because of the usually unsuitable conditions met with on the bottom of the sea, there being therefore a growing need for a system of such kind.

SUMMARY OF THE INVENTION

This invention consists of an integrated undersea repressurization system made up of a first undersea separator which the output from one or more petroleum wells is sent; a low pressure gas line which carries the gas separated out to a platform and the oil to the repressurization well; a power gas line from a compressor on the production platform to inject the gas into the bottom of the well through a hole; and a second undersea separator to which the mixture is led, provided with an oil outflow pipeline to the platform and a gas outflow pipeline to the production platform.

A further purpose of the invention concerns an undersea integrated repressurization method.

BRIEF DESCRIPTION OF THE DRAWINGS

The invention will now be described in greater detail with the help of the drawings attached hereto, where.

DETAILED DESCRIPTION OF INVENTION

Figure 1:
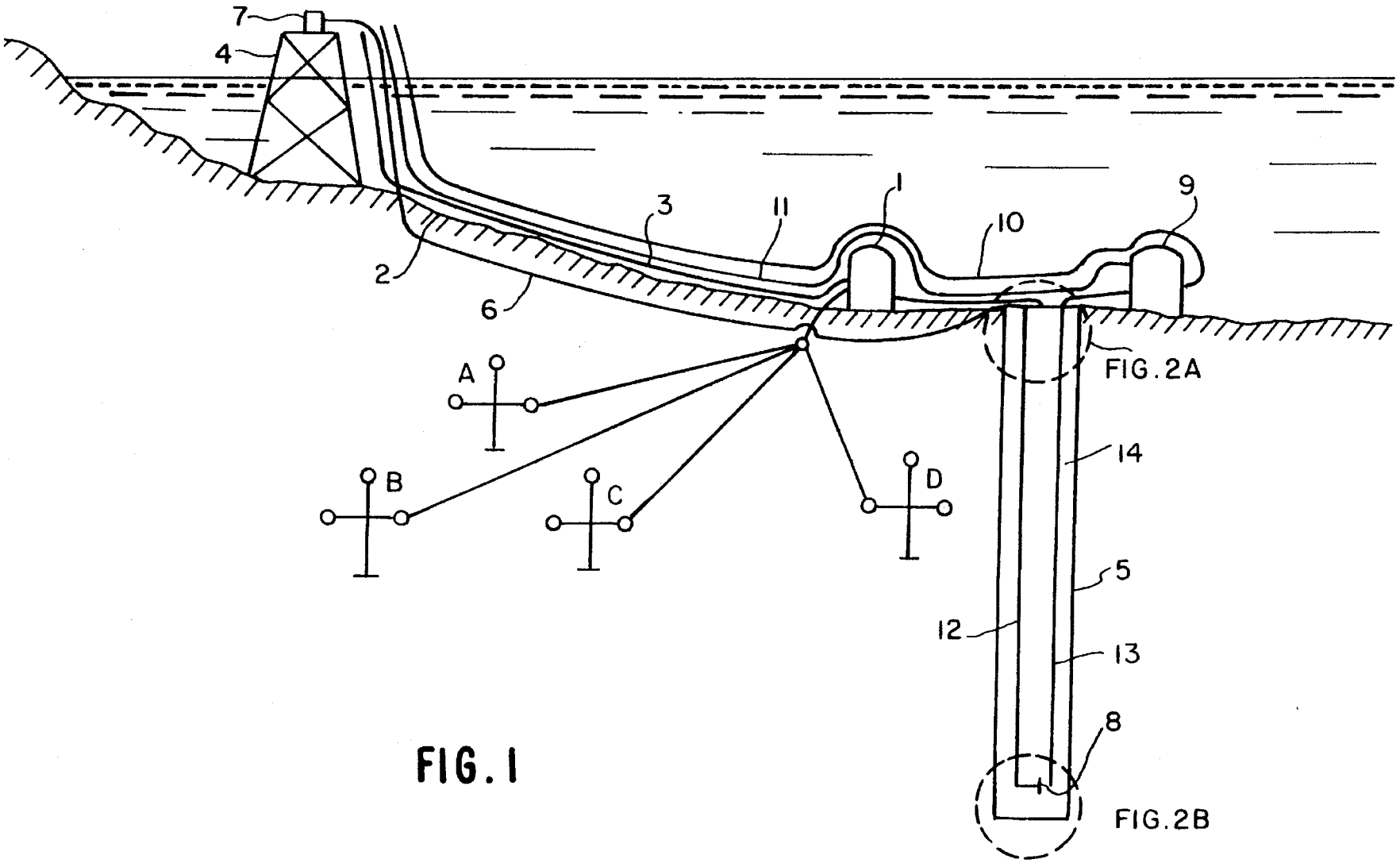
FIG. 1 is a view of the undersea integrated repressurization system of this invention.

The undersea integrated repressurization system and method according to the present invention makes use of the pressure differential between the oil and the gas. The output from one or more wells is collected and led to an undersea low pressure separator. After oil and gas have been separated the oil flows into quite a deep blind well. Because of the weight of the oil, gradient pressures at the bottom of the well are significantly higher than those at the well head. Depending on the diameter of the line that leads the separated oil to the bottom of the well, the downflow pressure difference can become quite close to the pressure difference of the head of oil. Gas is injected in the bottom of the well from a compressor lying on the production platform, or some other place, at a pressure higher than that of the oil at such depth. The mixture goes back to the sea bottom, arriving there at pressures significantly higher than the pressure at which the oil was injected, as can be seen from the difference in the hydrostatic pressure of the monophase oil flow and the two-phase liguid-gas) flow thereof. This process is like the artifical gas-lift raising of oil which works reliably and has been amply tested in satellite oil wells (wells completed with a wet Xmas tree)where operated with one hole only (without any kick-off valves), even though the idea is now used differently. Up to now gas-lift has been the only trustworthy artificial lifting method for subsea wet completed wells, and is used for a wide range of flow rates. The same kind of completion employed for wells where oil is produced by gas-lift may be used for this repressurized well, save for the second string, while the equipment used for gas-lift may be used for this invention.

This producing system also has the advantage of heating the oil gathered in the first stage of separation because of the heat transfer from the earth that goes on inside the pressurizing well.

The gas may be injected into a parallel or concentric string, inside or outside of the string by which the oil is to be lifted or within the space left between the two strings and the casing of the dummy well. Any of these three ways may be employed to convey one of the fluids (single phase downward flow of oil and gas and the oil-gas mixture upward flow). Such two phase mixture may be led thus up to the production station or separated again, each fluid—oil and gas—may be carried within a separate pipeline. If pressure after the separation is not enough to convey all of the production flow up to the production station on shore, or to a platform in shallower waters, the process is repeated with a further recompression stage (another dummy well) close to where the first stage of recompression (first well) lies, or at an intermediate spot. If so, the following advantages are to be had:

1—power gas compression pressure does not increase;

2—this is heating of the oil in the further repressurization stage because of the heat exchanges that take place within the well brought about by crosswise formations (geothermic heating). This heating may be very advantageous if the oil has a high cloud point and it also helps to offset line load losses caused by a decrease in oil viscosity.

When,it gets back to the production station the gas may be recompressed and put to use once again, as happens in the gas-lift process where no gas is actually spent, only the energy from the compression.

For this offshore production process, or in places difficult to reach, separation may take place in a vessel, or in a shaft close to or away from the dummy repressurization well, or over the repressurization well itself, or within an upper stretch thereof of wider diameter than the rest of the pressurizing well.

An example of the repressurization method, with typical valves of parameters, would be as follows:

Let us suppose that the oil and gas from the output lines of several wells are collected and separated at a pressure of 200 psi (13.608 atm) in a low pressure separator, this being the input pressure to the system. This oil is led to a wide diameter well, 9⅝" (0.143 m) for instance, and 660 m deep. Let us suppose that the oil reaches such depth at a pressure of 1000 psi (68.04 atm), which is less than the hydrostatic head. At such depth gas can be injected at a pressure of 1050 psi (77.44 atm) for instance, 50 psi (3.40 atm) of which has to overcome losses at the connection opening between the gas pipe and the riser. For an output of 3000 bbl/day (477 $m^3$/day) of 35° API oil along a 4" (0.102 m) line Kermit E. Broken states in his book, "Artificial Lift 2A" that there will be a drop in pressure of about 240 psi (16.330 atm) if gas in injected flow is at its lowest pressure gradient, for this particular situation somewhere around 1500 cubic feet of gas per barrel of oil (8421). Therefore pressure available at the repressurizing well head will be 760 psi (51.71 atm), which will be the separating pressure for the second stage of separation, if any. Therefore the oil which would have reached the repressurizing well at 200 psi (13.608 atm) gains 560 psi (38.102 atm), and can with the aid of such higher pressure overcome pressure losses up to the production station. In this example flow and injection pressures were low so as fit in with the figures shown in the graph referred to in the aforesaid book, but this does not mean that application of the method is in any way to be restricted to the parameters referred to in this example. Both flow rates and depth of well and also gas injection pressure may be greater or smaller for any given application.

The gas given off from the first stage of separation may be repressurized by means of an ejector together with the gas from the second stage, thereby saving a stretch of line, or conveyed to the production station, or otherwise disposed of. If a further repressurization stage is needed the gas given off by the second stage of separation of the first stage of compression may also be employed to repressurize the oil at an intermediate point of the flowline leading to the production station, of course in a shallower well, since its pressure will be lower, advantage being taken from the fact that the drop in pressure along a gas pipeline is a lot less than that along an oil pipeline.

In such further separation stage if the oil at 200 psi (13.808 atm) enters a 330 m deep well at a bottom pressure of 640 psi (43.546 atm) and if in its travel up to the further stage of separation the gas loses 120 psi (8.165 atm) up to the multiphase riser string then the mixture will get to the sea bottom at a pressure of 520 psi (35.381 atm), where it will undergo further partial or full separation before its single phase, that is, separated travel, if this is the best answer as regards economy, hydrodynamics, etc. Of course any other source of gas, or any other joint sources of gas could be used for such repressurization process in several stages.

If after having been repressurized the oil in the flow line has to travel along a long stretch whereby any gas therein would hinder proper flow because of the loss of load, and since upon separation the oil becomes saturated and any drop in pressure will lead to the appearance of a gaseous phase, some light hydrocarbon may be added, such as LPG (liquified petroleum gas), free from methane or ethane (or containing small amounts thereof), may be added in a suitable proportion, or any other substance or mixture of substance able to dissolve light hydrocarbons within oil, always after the repressurized oil has been separated, in order to displace the surrounding phase envelope of this repressurized mixture of oil and fluid added thereto, and thus enable such mixture to lose pressure while flowing without any gaseous phase making its appearance.

If the oil gets to the repressurization well at a low gas content, the repressurization method may do without the previous separation of fluids, but repressurization will become less efficient. This also means that if previous separation is not complete use of such method will not be ruled out at pumping.

Any water or solids coming from wells or otherwise put into the system will not prevent this methods from being used.

The gas employed may also be of any kind including all gaseous hydrocarbon mixtures and/or other gases (nitrogen, carbon dioxide, etc.) and not necessarily just natural gas previously dissolved or associated with the oil or not, and processed or not.

The undersea integrated repressurization system herewith invented as shown in FIG. 1 consists of a first undersea separator, 1, lying on sea bottom, 2, to which the output from wells A, B, C and D is conveyed after being collected therefrom; a low pressure gas line, 3, along which the gas flows to the production platform, 4, a line conveying the oil to repressurization well, 5; a power gas line, 6, from a compressor, 7, on the production platform, 4, for the gas to be injected into the bottom of well, 5, opening, 8; and a second undersea separator, 9, lying on the sea bottom, 2, to which the mixture is led on its way to outflow oil pipeline, 10, carrying the oil to production platform, 4, and a high pressure gas pipeline, 11, carrying gas to the production platform.

Figure 2A:
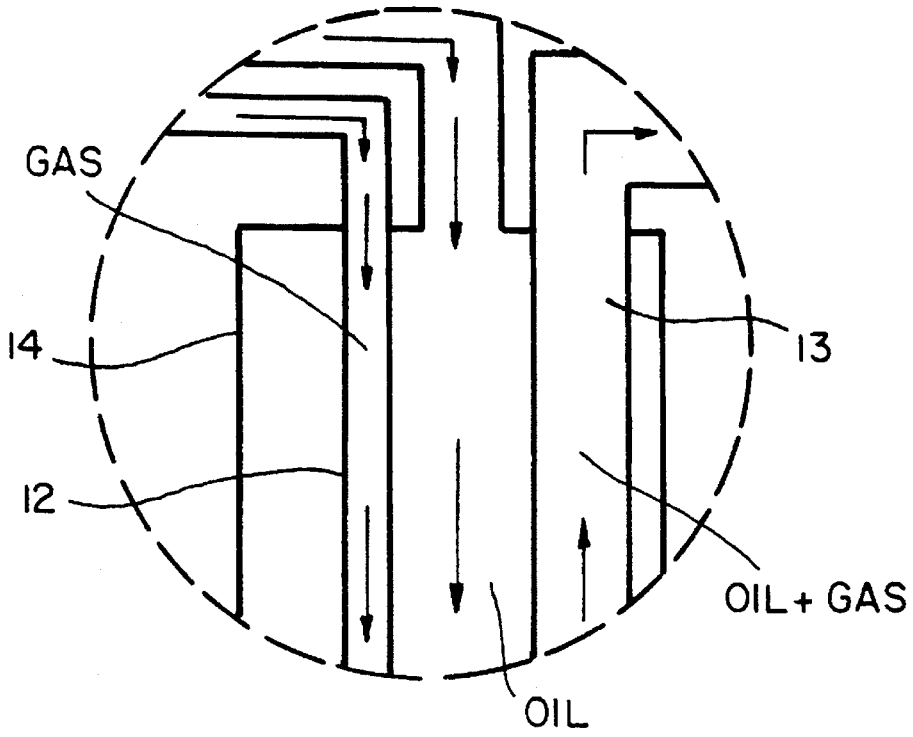
FIGS. 2A and 2B are details of FIG. 1 shown enlarged
Figure 2B:
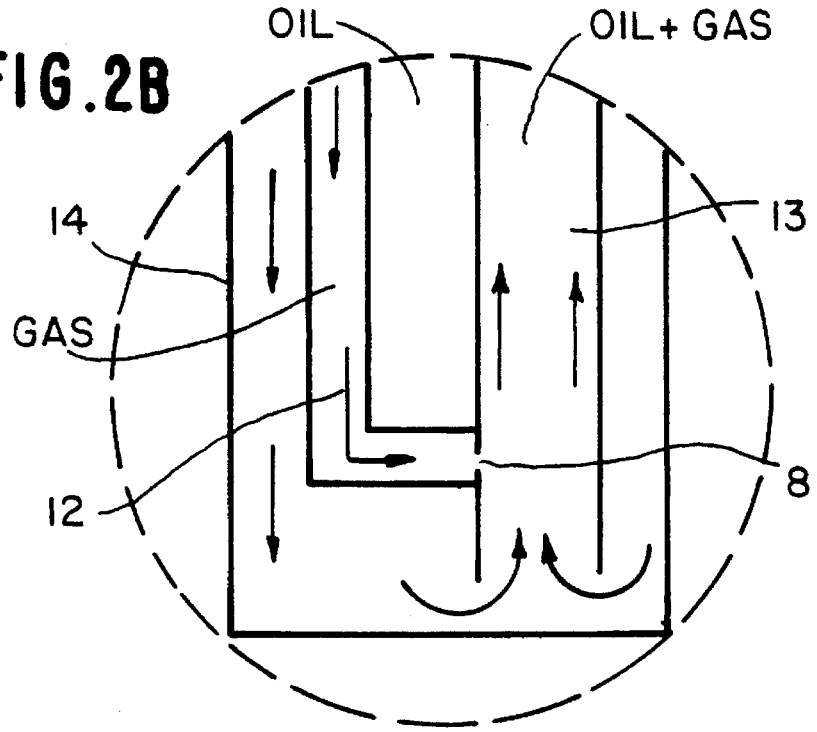

Yet another purpose of this invention concerns an undersea integrated repressurization method which employs the system shown in FIGS. 1, 2A and 2B consisting of the following stages:

a) collection and conveying of output from one or more of wells A, B, C and D, to a first undersea separator, 1, where oil and gas are separated out at low pressure.

b) travel of gas to production platform, 4, along low pressure gas line, 3 and travel of oil to repressurization strings, 12, 13 and the casing, 14, down to the bottom of repressurization well, 5, with gas being led down in single phase flow and oil and gas rising together in multiphase flow; well, 5;

c) entry of oil into string, 13, at the bottom of repressurization well, 5, due to difference in pressure, where, through opening, 8, power gas from compressor, 7, on production platform, 4, travelling along power gas line, 6, enters pipeline and lifts oil; and d) travel of mixture to high pressure separator, 9, from where oil flows along oilfield output pipeline 10, and gas along high pressure pipeline, 11, to production platform, 4.

I claim:

1. An undersea integrated repressurization system for undersea separation of oil and gas in deep waters and separate pumping of oil and gas to a production platform comprising, a first undersea separator lying on a sea bottom for collecting output from at least one well, a low pressure gas line connected to said first undersea separator for carrying gas to said production platform, an oil line connected to said first undersea separator for carrying oil to a repressurization well, a compressor disposed on said production platform, an output line connected to said compressor and extending into said repressurization well for injecting pressurized gas into a bottom of the repressurization well, a line extending from said bottom of the repressurization well and connected to a second undersea separator located on the sea bottom for conveying a mixture of oil and gas to said second undersea separator, an outflow line connected to said second undersea separator for carrying oil to said production platform and a high pressure line connected to said second undersea separator for carrying gas to said production platform.

2. An undersea integrated repressurization method for undersea separation of oil and gas in deep waters and separate pumping of oil and gas to a production platform comprising:

collecting and conveying output from at least one well to a low pressure undersea separator on a sea bottom;

separating oil and gas at low pressure in said low pressure undersea separator;

conveying gas from said low pressure undersea separator to a production platform along a low pressure line and conveying oil from said low pressure undersea separator to a bottom of a repressurization well;

injecting pressurized gas from a compressor on said production platform to said bottom of said repressurization well;

conveying a mixture of oil and gas through an output line from said bottom of said repressurization well to a high pressure undersea separator lying on said sea bottom for separating said oil and gas and conveying oil and gas separately through an output line and a high pressure line, respectively to said production platform.

3. A method as set forth in claim 2, wherein pressures at said bottom of said repressurization well are considerably higher than those at a well head of said repressurization well because of hydrostatic oil pressure.

4. A method as set forth in claim 2, wherein pressurized gas from said compressor is injected into the bottom of said repressurization well at a higher pressure than oil pressure at the bottom of said repressurization well.

5. A method as set forth in claim 2, wherein said mixture of oil and gas arrives at said high pressure undersea separator at a pressure significantly higher than that at which oil was injected into said repressurization well as seen from difference in gradient of single phase oil flow and two phase oil-gas flow.

6. A method as set forth in claim 2, wherein said pressurized gas is injected into said bottom of said repressurization well through a first string of pipes and said mixture of oil and gas is conveyed from said bottom of said repressurization well to said high pressure undersea separator through a parallel string of pipes with the oil from said low pressure undersea separator being conveyed to the bottom of said repressurization well through space left between said two strings of pipes and a casing.

7. A method as set forth in claim 2, wherein if pressure after separation in said high pressure undersea separator is not sufficient to carry full production flow up to said platform, the method is repeated with another repressurization well.

8. A method as set forth in claim 2, wherein if, after repressurization, the output line from said high pressure undersea separator has to run along a long sloping stretch where any gas in the output line would affect oil flow because of a rising drop in load and since during separation oil will be saturated and any loss of pressure would lead to appearance of a gaseous phase, a hydrocarbon substantially free from methane and ethane is added in a suitable proportion so as to displace surrounding phase envelope of repressurized oil mixture and added hydrocarbon to enable such mixture to drop in pressure while flowing without any gas phase appearing.

9. A method as set forth in claim 8, wherein said hydrocarbon is liquified petroleum gas.

10. A method as set forth in claim 2, wherein said pressurized gas is a mixture of gaseous hydrocarbons.

* * * * *